US010704852B2

(12) United States Patent
Michut

(10) Patent No.: US 10,704,852 B2
(45) Date of Patent: Jul. 7, 2020

(54) FIREARM FRAME LOCKING SYSTEM

(71) Applicant: Viktor Michut, Stiavnik (SK)

(72) Inventor: Viktor Michut, Stiavnik (SK)

( * ) Notice: Subject to any disclaimer, the term of this patent is extended or adjusted under 35 U.S.C. 154(b) by 0 days.

(21) Appl. No.: 16/468,028

(22) PCT Filed: Dec. 21, 2017

(86) PCT No.: PCT/SK2017/050010
§ 371 (c)(1),
(2) Date: Jun. 10, 2019

(87) PCT Pub. No.: WO2018/117981
PCT Pub. Date: Jun. 28, 2018

(65) Prior Publication Data

US 2020/0011626 A1 Jan. 9, 2020

(30) Foreign Application Priority Data

Dec. 21, 2016 (SK) ..... 50087-2016

(51) Int. Cl.
*F41A 11/00* (2006.01)

(52) U.S. Cl.
CPC ..... *F41A 11/00* (2013.01)

(58) Field of Classification Search
CPC F41A 11/00; F41A 11/02; F41A 11/04; F41A 11/05
USPC ..... 42/75.01, 75.03
See application file for complete search history.

(56) References Cited

U.S. PATENT DOCUMENTS 4,580,484 A 4/1986 Moore
7,823,314 B1 11/2010 Wheatley
9,188,399 B1 * 11/2015 Findlay ..... F41A 3/66
2006/0277810 A1 * 12/2006 Leitner-Wise ..... F41A 3/66 42/75.03
2009/0071053 A1 3/2009 Thomele et al.
2009/0139128 A1 * 6/2009 Fluhr ..... F41C 23/04 42/71.01
2010/0281742 A1 * 11/2010 Barrett ..... F41A 11/04 42/75.02
2013/0036645 A1 * 2/2013 Chvala ..... F41C 23/04 42/73
2014/0165442 A1 * 6/2014 Nebeker ..... F41A 11/00 42/16
2018/0080736 A1 * 3/2018 Olsen ..... F41C 23/04

OTHER PUBLICATIONS

International Search Report and Written Opinion of the International Search Authority issued in PCT Application No. PCT/SK2017/050010 dated Apr. 5, 2018.

* cited by examiner

*Primary Examiner* — Bret Hayes

(74) *Attorney, Agent, or Firm* — LeonardPatel P.C.; Michael Aristo Leonard, II; Sheetal Suresh Patel

(57) ABSTRACT

A firearm frame locking system locks a two-part firearm frame. This is achieved by a firearm frame locking system that includes an upper frame and a lower frame that slide into each other by means of projections that fit into grooves in both the upper frame and the lower frame. In the lower frame, a double-arm lever is located along the longitudinal axis of the firearm. One arm of the double-arm lever extends at least partially into/through a vertical hole in a horizontal rib of the lower frame. A second arm of the double-arm lever ends in the opposite position to a projection in the upper frame. A spring is placed between the horizontal arm and the rib.

20 Claims, 2 Drawing Sheets

[Fig. 1]
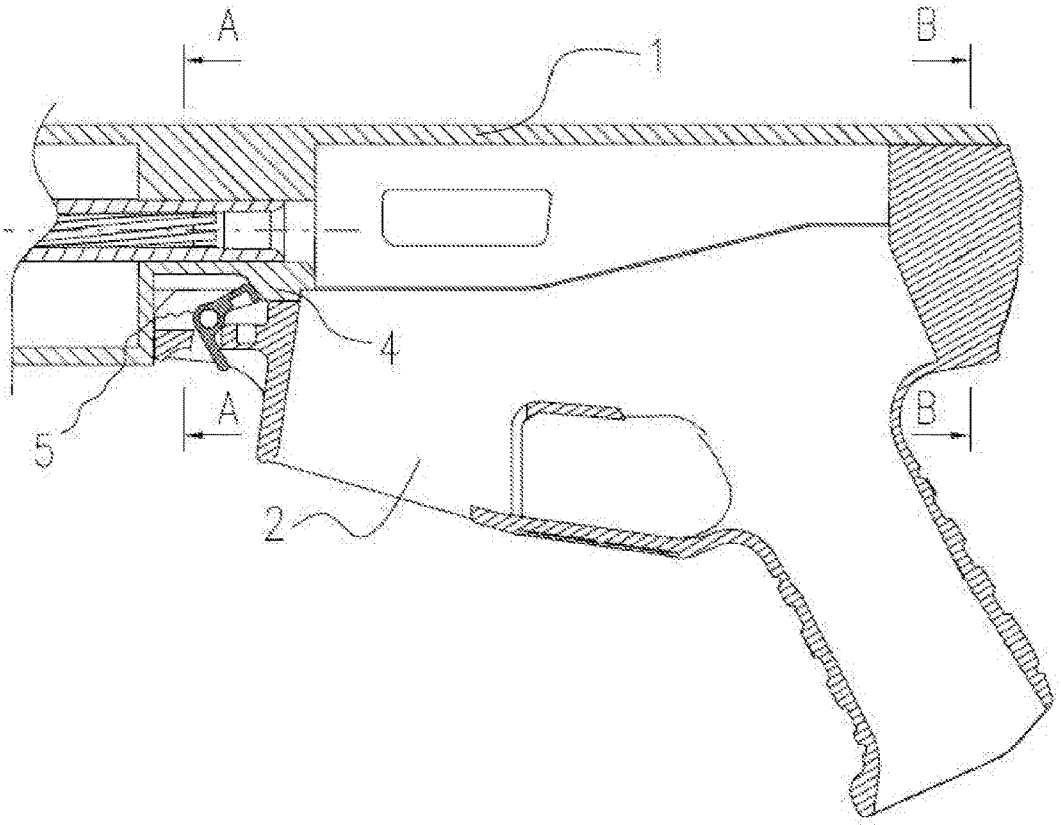
[Fig. 2]
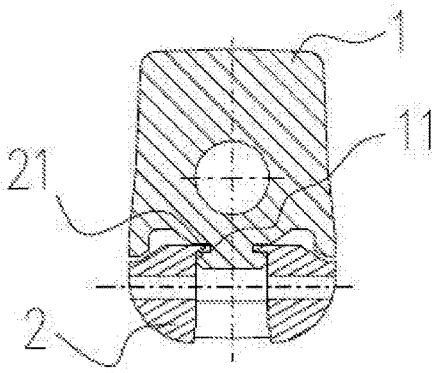
[Fig. 3]
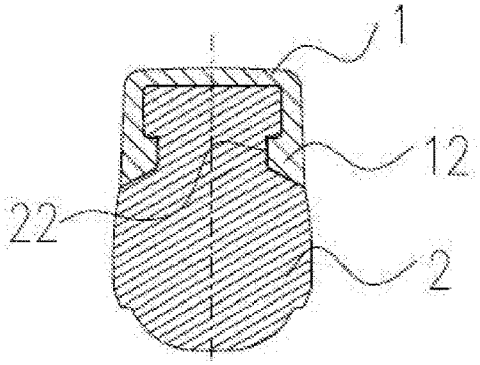

[Fig. 4]
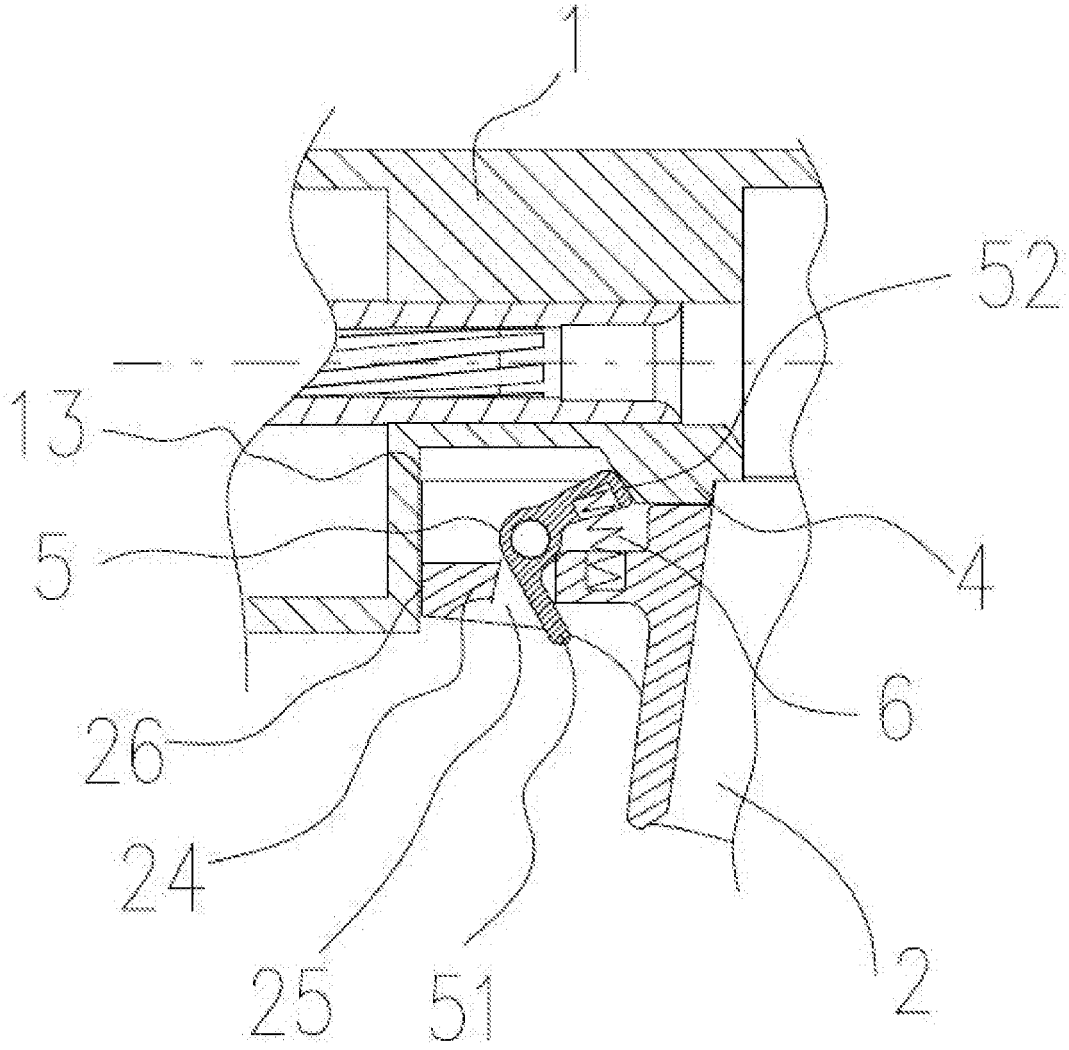

FIREARM FRAME LOCKING SYSTEM

CROSS REFERENCE TO RELATED APPLICATIONS

This application is a U.S. national stage application under 35 U.S.C. § 371 of PCT Application Number PCT/SK2017/050010 filed Dec. 21, 2017, which claims the benefit of Slovakian Patent Application Number PP 50087-2016 filed Dec. 21, 2016. The subject matter of these earlier filed patent applications is hereby incorporated by reference in its entirety.

FIELD

The invention generally related to firearm frame locking systems, and more particularly, to a firearm frame locking system suitable for locking a two-part firearm frame.

BACKGROUND

Firearms, in order to be maintained, checked and cleaned, need to be disassembled into basic groups of parts. In general, various systems, using various forms of connections based on the principle of one or several pins, are used to connect such groups of parts into a unit. The pins turn or slide sideways, perpendicular to the axis of the barrel, which allows the firearm to be disassembled into basic groups after performing the required actions. The pins, whose shapes and finish may vary, either come out completely, as described in U.S. Pat. No. 4,580,484, or remain partially attached to one of the groups, as featured in the design of the Sa 58 automatic assault rifle.

The general disadvantage of conventional designs is the complexity of these designs, the risk of losing the pins, and a lengthy disassembly and reassembly process for users, which may be a significant burden to users. These considerations gave rise to the task of searching for such a design of a firearm frame locking mechanism that shortens the time required for firearm disassembly and reassembly, and that prevents the possibility of losing the locking mechanism during firearm disassembly. Accordingly, an improved design may be beneficial.

SUMMARY

Certain embodiments of the present invention may provide solutions to the problems and needs in the art that have not yet been fully identified, appreciated, or solved by current firearm technologies. For example, some embodiments of the present invention pertain to a frame locking system of a firearm whose frame includes an upper and a lower frame sliding into each other by means of projections that fit into grooves created in both the upper and lower frame. Some embodiments feature a double-arm swinging lever placed in the lower frame along the longitudinal axis of the firearm. One of the arms of the lever may end in a vertical hole in a horizontal rib of the lower frame, and the second arm may end opposite a projection in the upper frame. A preloaded compression spring may be placed between the second arm of the double-arm swinging lever and the rib of the front part of the lower frame.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which:

FIG. 1 illustrates the longitudinal section of the firearm with an assembled frame, according to an embodiment of the present invention.

FIG. 2 illustrates the cross-section of the firearm at the A-A position of FIG. 1, according to an embodiment of the present invention.

FIG. 3 illustrates the cross-section of the firearm at the B-B position of FIG. 1, according to an embodiment of the present invention.

FIG. 4 illustrates the detailed view of the placement of the locking mechanism in the frame, according to an embodiment of the present invention.

DETAILED DESCRIPTION OF THE EMBODIMENTS

Some embodiments of the present invention pertain to a firearm frame locking system suitable for locking a two-part firearm frame. Referring to FIGS. 1-4, the locking system of a firearm frame in an embodiment includes an upper frame 1 and a lower frame 2 that slide into each other by means of a projection 21 created in the front part of the lower frame. The projection 21 fits into a groove 11 in the middle part of the upper frame 1. In the rear part of the firearm, the upper frame 1 and the lower frame 2 are attached by means of a projection 12 in the rear part of the upper frame 1. The projection 12 fits into a groove 22 in the rear part of the lower frame 2.

A double-arm swinging lever 5 is placed in the front part of the lower frame along the longitudinal axis of the firearm. One of the arms 51 of the double-arm lever 5 ends in a vertical hole 25 in the horizontal rib 24 of the front part of the lower frame 2. The other arm 52 of the double-arm lever 5 ends in an opposite position to a projection 4 in the middle part of the upper frame 1. A preloaded compression spring 6 is placed between the arm 52 of the double-arm lever 5 and the rib 24 of the front part of the lower frame 2.

By inserting the projections 12, 21 into the grooves 11, 22, the upper frame 1 becomes attached and locked to the lower frame 2 when the face 26 of the front part of the lower frame 2 touches the vertical wall 13 of the upper frame. The locking of the firearm frame (i.e., the fixing of the upper frame 1 and the lower frame 2 to prevent them from moving in opposite directions, perpendicular to the longitudinal axis of the firearm) is ensured by inserting the projections 12, 21 into the grooves 11, 22. The fixing of the upper frame 1 and the lower frame 2 to prevent them from moving in opposite directions, along the longitudinal axis of the firearm, is ensured when the face 26 of the front part of the lower frame 2 touches the vertical wall 13 of the upper frame 1, and by touching the arm 52 of the double-arm lever 5 to the projection 4 of the upper frame 1.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A frame locking system for a firearm, comprising:
an upper frame comprising a locking projection;
a lower frame comprising a rib, the rib comprising a hole; and
a double-arm lever located in the lower frame, the double-arm lever comprising a pair of arms, wherein
the upper frame and the lower frame are configured to slide into one another and lock together, and
when the upper frame and the lower frame are locked together:
a first arm of the double-arm lever extends at least partially into/through the hole of the rib, and
a second arm of the double-arm lever ends in an opposite position to the locking projection of the upper frame.

2. The frame locking system of claim 1, further comprising:
a compression spring located between the second arm of the double-arm lever and the rib of the lower frame.

3. The frame locking system of claim 1, wherein the a double-arm lever is located in the lower frame along a longitudinal axis of the firearm.

4. The frame locking system of claim 1, wherein the locking projection is located in a middle part of the upper frame.

5. The frame locking system of claim 1, wherein
the upper frame comprises a first sliding projection and a first groove,
the lower frame comprises a second sliding projection and a second groove,
the first sliding projection of the upper frame is configured to slide into the second groove of the lower frame, and
the second sliding projection of the lower frame is configured to slide into the first groove of the upper frame.

6. The frame locking system of claim 5, wherein
a front part of the lower frame comprises a face,
the upper frame comprises a vertical wall, and
the upper frame becomes attached and locked to the lower frame by inserting the first sliding projection and second sliding projection into the second groove and the first groove, respectively when the face of the front part of the lower frame touches the vertical wall of the upper frame, and by touching the second arm of the double-arm lever to the locking projection of the upper frame.

7. The frame locking system of claim 1, wherein
the upper frame comprises a groove,
the lower frame comprises a sliding projection, and
the upper frame and the lower frame are configured to slide into one another via the sliding projection and the groove.

8. The frame locking system of claim 7, wherein the sliding projection is located in a rear part of the upper frame and the groove is located in a rear part of the lower frame.

9. The frame locking system of claim 1, wherein
the lower frame comprises a groove,
the upper frame comprises a sliding projection, and
the upper frame and the lower frame are configured to slide into one another via the sliding projection and the groove.

10. The frame locking system of claim 9, wherein the sliding projection is located in a front part of the lower frame and the groove is located in a middle part of the upper frame.

11. The frame locking system of claim 1, wherein the rib is a horizontal rib and the hole is a vertical hole.

12. The frame locking system of claim 1, wherein the gun is a handgun.

13. A frame locking system for a firearm, comprising:
an upper frame comprising a locking projection;
a lower frame comprising a rib, the rib comprising a hole;
a double-arm lever located in the lower frame along a longitudinal axis of the firearm, the double-arm lever comprising a first arm and a second arm; and
a compression spring located between the second arm of the double-arm lever and the rib of the lower frame, wherein
the upper frame and the lower frame are configured to slide into one another and lock together, and
when the upper frame and the lower frame are locked together:
the first arm of the double-arm lever extends at least partially into/through the hole of the rib, and the second arm of the double-arm lever ends in an opposite position to the locking projection of the upper frame.

14. The frame locking system of claim 13, wherein the upper frame comprises a first sliding projection and a first groove, the lower frame comprises a second sliding projection and a second groove, the first sliding projection of the upper frame is configured to slide into the second groove of the lower frame, and the second sliding projection of the lower frame is configured to slide into the first groove of the upper frame.

15. The frame locking system of claim 14, wherein a front part of the lower frame comprises a face, the upper frame comprises a vertical wall, and the upper frame becomes attached and locked to the lower frame by inserting the first sliding projection and second sliding projection into the second groove and the first groove, respectively when the face of the front part of the lower frame touches the vertical wall of the upper frame, and by touching the second arm of the double-arm lever to the locking projection of the upper frame.

16. The frame locking system of claim 13, wherein the upper frame comprises a groove, the lower frame comprises a sliding projection, the upper frame and the lower frame are configured to slide into one another via the sliding projection and the groove, and the sliding projection is located in a rear part of the upper frame and the groove is located in a rear part of the lower frame.

17. The frame locking system of claim 13, wherein the lower frame comprises a groove, the upper frame comprises a sliding projection, the upper frame and the lower frame are configured to slide into one another via the sliding projection and the groove, and the sliding projection is located in a front part of the lower frame and the groove is located in a middle part of the upper frame.

18. The frame locking system of claim 13, wherein the rib is a horizontal rib and the hole is a vertical hole.

19. The frame locking system of claim 13, wherein the gun is a handgun.

20. A frame locking system for a firearm, comprising:

an upper frame comprising a locking projection, a first sliding projection, and a first groove;

a lower frame comprising a horizontal rib, a second sliding projection, and a second groove, the horizontal rib comprising a vertical hole;

a double-arm lever located in the lower frame along a longitudinal axis of the firearm, the double-arm lever comprising a first arm and a second arm; and a compression spring located between the second arm of the double-arm lever and the horizontal rib of the lower frame, wherein the upper frame and the lower frame are configured to slide into one another and lock together, the first sliding projection of the upper frame is configured to slide into the second groove of the lower frame, the second sliding projection of the lower frame is configured to slide into the first groove of the upper frame, and when the upper frame and the lower frame are locked together:

the first arm of the double-arm lever extends at least partially into/through the vertical hole of the horizontal rib, and the second arm of the double-arm lever ends in an opposite position to the locking projection of the upper frame.

* * * * *